US006997998B2

(12) United States Patent
Hagel et al.

(10) Patent No.: US 6,997,998 B2
(45) Date of Patent: Feb. 14, 2006

(54) LEAD-AND BARIUM-FREE PROPELLANT CHARGES

(75) Inventors: Rainer Hagel, Erlangen (DE); Klaus Redecker, Nuremberg (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 10/752,536

(22) Filed: Jan. 8, 2004

(65) Prior Publication Data

US 2005/0067073 A1 Mar. 31, 2005

Related U.S. Application Data

(63) Continuation of application No. 10/373,405, filed on Feb. 26, 2003, now abandoned, which is a continuation of application No. 10/164,583, filed on Jun. 10, 2002, now abandoned, which is a continuation of application No. 09/739,235, filed on Dec. 19, 2000, now abandoned, which is a continuation of application No. 09/251,474, filed on Feb. 17, 1999, now abandoned, which is a continuation of application No. 08/875,214, filed as application No. PCT/EP96/04674 on Oct. 26, 1996, now abandoned.

(30) Foreign Application Priority Data

Oct. 28, 1995 (DE) ..... 195 40 278

(51) Int. Cl.
*C06B 33/08* (2006.01)
*C06B 33/04* (2006.01)
*C06B 25/04* (2006.01)

(52) U.S. Cl. ..... 149/38; 149/43; 149/45; 149/105

(58) Field of Classification Search ..... 149/38, 149/43, 45, 105

See application file for complete search history.

(56) References Cited

U.S. PATENT DOCUMENTS

| | | | | |
|---|---|---|---|---|
| 3,321,342 | A * | 5/1967 | Burton et al. | 149/19.6 |
| 3,972,677 | A | 8/1976 | Schupp | |
| 4,145,969 | A | 3/1979 | Gawlick et al. | |
| 4,363,679 | A | 12/1982 | Hagel et al. | |
| 4,464,989 | A | 8/1984 | Gibson et al. | |
| 4,575,379 | A | 3/1986 | Browning | |
| 4,581,082 | A | 4/1986 | Hagel et al. | |
| 4,858,534 | A | 8/1989 | Wallace | |
| 4,956,029 | A | 9/1990 | Hagel et al. | |
| 5,059,261 | A | 10/1991 | Condo et al. | |
| 5,167,736 | A | 12/1992 | Mei et al. | |
| 5,216,199 | A | 6/1993 | Bjerke et al. | |
| 5,353,707 | A | 10/1994 | Duguet | |
| 5,538,569 | A | 7/1996 | Carter | |
| 5,567,252 | A | 10/1996 | Mei et al. | |
| 5,672,219 | A | 9/1997 | Rinaldi et al. | |
| 5,936,190 | A | 8/1999 | Buzick | |

FOREIGN PATENT DOCUMENTS

| | | |
|---|---|---|
| WO | 97/16397 | 5/1997 |

* cited by examiner

*Primary Examiner*—Aileen Felton
(74) *Attorney, Agent, or Firm*—Antonelli, Terry, Stout and Kraus, LLP.

(57) ABSTRACT

The subject of the present invention is lead- and barium-free propellant charges with primary explosives mixed with oxygen-supplying substances, characterized in that the primary explosives are selected from alkali metal and/or alkaline earth metal salts of dinitrobenzofuroxanes and the oxygen-supplying substances are chosen from metal peroxides, nitrates of ammonium, guanidine, aminoguanidine, triaminoguanidine, dicyanodiamidine, and the elements sodium, potassium, magnesium, calcium, cerium, and/or multivalent metal oxides.

The propellant charges according to the invention exhibit increased stability with respect to known propellant charges that are free of harmful substances.

35 Claims, No Drawings

LEAD-AND BARIUM-FREE PROPELLANT CHARGES

This application is a Continuation Application of application Ser. No. 10/373,405 filed Feb. 26, 2003 now abandoned, which is a Continuation Application of application Ser. No. 10/164,583, filed Jun. 10, 2002 (now abandoned), which application is a Continuation application of Ser. No. 09/739,235, filed Dec. 19, 2000 (now abandoned), which application is a continuation of application Ser. No. 09/251,474 filed Feb. 17, 1999 (now abandoned), which is a continuation of application Ser. No. 08/875,214, filed on Dec. 17, 1997 (now abandoned), which is a national stage application under 35 U.S.C. 371 of PCT/EP96/04674, filed Oct. 26, 1996.

The subject of the invention is lead- and barium-free propellant charges with priming explosives mixed with oxygen-supplying substances.

The use of zinc peroxide as the sole or additional oxidant in mixtures containing explosives or pyrotechnic mixtures is known from EP-0 031 045 B1.

EP-0 129 081 B1 describes lead- and barium-free propellant charges composed of priming explosives mixed with zinc peroxide as the oxidant, said charges containing strontium salts of mono- and/or dinitrodihydroxydiazobenzene in amounts between 5 and 70 wt. % mixed with passivators as well as, in addition, tetrazine in amounts up to 30 wt. % and zinc peroxide in amounts between 10 and 70 wt. %, relative to the total mixture in each case, as priming explosives.

Known propellant charges contain as priming explosives, compounds especially of lead that are derived from trinitropolyphenols, such as trinitrophenol, trinitrolresorcin, or hydrazoic acid. In addition, propellant charges are also known that contain the double salts of lead, for example hypophosphite nitrate. When these propellant charges burn, increased concentrations of lead and its compounds occur in the ambient air that reach the admissible limiting concentrations after only a small number of rounds. Solutions have already been proposed that consist of priming explosives that are free of heavy metals. Diazodinitrophenol has proven especially successful in this regard. However, propellant charges containing diazodinitrophenol, with zinc peroxide for example as the substance that supplies oxygen, exhibit very strong gas pressure surges caused by the violently reacting diazodinitrophenol. This can result in problems with weapon function or with internal and external ballistics. In addition, diazodinitrophenol exhibits elevated thermal reactivity.

The subject of the present invention therefore consists in improved lead- and barium-free propellant charges with priming explosives mixed with substances that supply oxygen.

A first embodiment to solve the above problem therefore consists in lead- and barium-free propellant charges with priming explosives mixed with oxygen-supplying substances, characterized in that the priming explosives are selected from alkali metal and/or alkaline earth metal salts of dinitrobenzofuroxanes and the oxygen-supplying substances are chosen from metal peroxides, nitrates of ammonium, guanidine, aminoguanidine, triaminoguanidine, and dicyanodiamidine, and the elements sodium, potassium, magnesium, calcium, cerium, and/or multivalent metal oxides.

The propellant charges according to the invention exhibit improved stability over the prior art when stored in a moist or warm location.

As the priming explosive according to the present invention, in addition to the known salts of mono- and/or dinitrodihydroxydiazobenzene, diazodinitrophenol, triazol- and tetrazol compounds, the salts of nitrotriazolone and the salts of dinitrobenzofuroxan, especially the potassium salt, can be used in addition. As organic compounds with functional azide groups, cyanuric acid, triazidotrinitrobenzene, styphnyldiazide, or 2-picryl-5-nitrotetrazol can be mentioned.

According to the invention, the priming explosives are preferably used in an amount of 5 to 70 wt. %, especially 30 to 60 wt. %. based on the total mixture.

As the oxygen-supplying substances, in addition to the metal peroxide, zinc peroxide, known of itself from the prior art, other oxygen-supplying substances may be used. As the additional substances in this regard, the following can be used for example in the propellant charge: stannic oxide, cerium dioxide, tungsten trioxide and/or nitrates of ammonium, guanidine, aminoguanidin, triaminoguanidin, dicyanodiamidine, and the elements sodium, potassium, magnesium, calcium, cerium, and especially potassium nitrate or basic cerium nitrate. The quantities of oxygen-supplying substances in the propellant charges according to the invention can be between 5 and 70 wt. % for example, based on the total mixture. An amount of 8 to 60 wt. % of the oxygen-supplying substance is especially preferable according to the invention. The substances can be used both in a finely pulverulent state and in a coarsely pulverulent state. Finely pulverulent substances with an average grain size of about 10 $\mu$m are preferably used when the propellant charges are used as compressed charges, while coarsely pulverulent substances with a grain size of about 30 $\mu$m are especially suitable for less powerfully compressed charges, for example in rim fire charges.

According to the invention, the propellant charges can also contain sensitizers, reducing agents, friction agents, secondary explosives, and/or inert substances.

When sensitizers, preferably tetrazene, are used, amounts from 0 to 30 wt. % based on the total mixture can be present.

Reducing agents that contribute to conversion are suitable in the propellant charges according to the invention for improving the ignition capacity and also partly produce an increase in mechanical sensitivity. Suitable substances are preferably chosen from carbon and/or metal powders, especially boron, aluminum, cerium, titanium, zirconium, magnesium, and silicon, from metal alloys especially cerium-magnesium, cerium-silicon, titanium-aluminum, aluminum-magnesium, and calcium silicide and from metal sulfides especially antimony sulfide and molybdenum sulfide, as well as from metal hydrides, titanium hydride for example, especially in an amount of 0 to 20 wt. %, based on the total mixture. Some reducing agents can simultaneously also serve as a friction medium, for example antimony sulfides or calcium silicides. While the amount of reducing agent in the propellant charge can be 0 to 20 wt. %, friction agents that do not participate in the conversion process during combustion can be present in amounts of up to 45 wt. % based on the total mixture in the propellant charges according to the invention. Such friction agents are known of themselves; glass powder is an example.

Secondary explosives such as nitrocellulose or pentaerythrite tetranitrate for example are especially suitable as other components that contribute to the reaction. Other examples that could be mentioned are octogen and hexogen, as well as amino compounds of nitrated aromatics, trinitrobenzene for example, such as mono-, di-, or triaminotrinitrobenzene or aminohexanitrodiphenyl, as well as the acylation products of these compounds, such as hexanitrooxanilide, or hexanitrodiphenyl urea for example. In addition, these secondary explosives include for example hexanitrostilbene, hexanitrodiphenyloxide, hexanitrodiphenylsulfide, hexanitrodiphenylsulfone, and hexanitrodiphenylamine as well as tetranitrocarbazol, tetranitroacridone, or polyvinyl nitrate, as well as nitrotriazolone and its compounds. The amounts of these substances in the propellant charge can be 0 to 30 wt. % of the total mixture.

Substances known of themselves are suitable for use as inert substances in the propellant charges according to the invention, said substances often being added to adjust the properties of these charges to individual applications. In particular, binders, adhesives, dyes, passivators, and/or substances for characterizing odor could be mentioned in this connection and which preferably can be contained in amounts of 0 to 20 wt. % based on the total mixture. Calcium carbonate, titanium dioxide, and/or white boron nitride can be mentioned as examples.

To improve and characterize the odor of the smoke produced by the propellant charge, the charge mixture or the binder as well as the covering of the charge can have means for characterizing odor added to them which are suitable for resisting thermal stress during firing. In particular, it has been found that vanillin exhibits these properties.

The manufacture of the propellant charges according to the invention is performed using methods known of themselves by screening the mixture when dry or by kneading the mixture after it has been moistened with water. The mass moistened with water can then be metered by smearing it on perforated plates or by extrusion molding.

EXAMPLES

Example 1

This example describes a propellant charge for an anvil percussion cap with a 20 mg load.

A mixture of 45 parts by weight of potassium dinitrobenzofuroxanate, 5 parts by weight tetrazene, 30 parts by weight zinc peroxide, 15 parts by weight stannous dioxide, and 5 parts by weight of titanium was homogenized with 22 parts by weight of water and metered by smearing on perforated plates. After being placed in percussion caps, the mixtures were dried and pressed.

The flammable mixture according to the invention, when stored in moisture and heat at a temperature of 71° C. and an atmospheric humidity of 90% for 7 days, exhibited better stability than a conventional diazol-containing propellant charge. No expulsion of the primer cap from the cartridges was observed during the sensitivity test.

Comparison Example 1

A mixture moistened with water and composed of 40 parts by weight of diazodinitrophenol, 15 parts by weight of tetrazene, 8 parts by weight of zinc peroxide, 35 parts by weight of glass powder (120 to 170 $\mu$m), and 2 parts by weight of Adhesin® (adhesive) were tossed into 0.221fB rim fire cartridges, 18 mg each.

The propellant charge required a varnish layer of 3 to 4 mg Vinnapas® A50 as wadding for reliable complete ignition, said layer containing 0.2 mg vanillin to characterize the odor.

Example 2

Similarly to Example 1, a propellant charge for 0.221fB rim fire cartridges, 16 mg each, was produced. A mixture of 47 parts by weight of potassium dinitrobenzofuroxanate, 10 parts by weight of tetrazene, 8 parts by weight of zinc peroxide, 34 parts by weight of glass powder (90 to 200 $\mu$m), and 1 part by weight of Adhesin® (adhesive) was processed similarly to Example 1.

The propellant charge burned through without covering varnish as wadding and achieved internal and external ballistics comparable to those of commercial ammunition.

What is claimed is:

1. A lead-free and barium-free ignition composition that contains at least one initial explosive in a mixture with at least one oxygen-delivering substance, the composition consisting essentially of:

at least one alkali metal and/or at least one alkali earth metal salt of dinitrobenzofuroxan as the sole initial explosive, tetrazene as a sensitizer, and at least one of metal peroxides, cerium dioxide, tungsten trioxide, nitrates of ammonium, guanidine, aminoguanidine, triaminoguanidine, dicyanodiamidine, the elements sodium, magnesium, calcium and/or cerium as the oxygen-delivering substance, and further containing a reduction agent selected from the group consisting of carbon, metal powders of boron, cerium, titanium, zirconium and/or silicon, metal alloys, metal sulfides and metal hydrides.

2. The lead-free and barium-free ignition composition of claim 1 wherein the at least one initial explosive is contained in the composition in an amount of from 5 to 70% by weight, relative to the entire mixture.

3. The lead-free and barium-free ignition composition of claim 1 wherein the at least one initial explosive is contained In the composition in an amount of from 30 to 60% by weight, relative to the entire mixture.

4. The lead-free and barium-free ignition composition of claim 1 wherein the oxygen-delivering substance is contained in the composition in an amount of from 5 to 70% by weight, relative to the entire mixture.

5. The lead-free and barium-free ignition composition of claim 1 wherein the oxygen delivering substance is contained in the composition in an amount of from 8 to 60% by weight, relative to the entire mixture.

6. The lead-free and barium-free ignition composition of claim 1 wherein the reduction agent is selected from the group consisting of cerium-magnesium, cerium-silicon, titanium-aluminum, aluminum-magnesium, antimony sulfide molybdenum sulfide, titanium hydride and mixtures thereof.

7. The lead-free and barium-free ignition composition of claim 1 wherein the reduction agent is contained in an amount of from greater than 0 to 20% by weight, relative to the entire mixture.

8. The lead-free and barium-free ignition composition of claim 1, wherein the composition further contains at least one friction agent, at least one additional sensitizer, at least one additional secondary explosive and/or at least one inert substance.

9. The lead-free and barium-free ignition composition of claim 1, wherein the composition further contains at least one additional sensitizer and wherein the sensitizers are contained in an amount of from 0 to 30% by weight, relative to the entire mixture.

10. The lead-free and barium-free ignition composition of claim 1, wherein the composition further contains glass powder as a friction agent.

11. The lead-free and barium-free ignition composition of claim 1, wherein the composition further contains at least one friction agent in a amount of from more than 0 to 45% by weight, relative to the entire mixture.

12. The lead-free and barium-free ignition composition of claim 1 wherein the composition further contains at least one secondary explosive selected from the group consisting of hexogen and amino compounds of nitrated aromatics.

13. The lead-free and barium-free ignition composition of claim 1 wherein the composition further contains at least one secondary explosive in a amount of from more than 0 to 30% by weight, relative to the entire mixture.

14. The lead-free and barium-free ignition composition of claim 1, wherein the composition further contains at least one inert substance selected from the group consisting of a binder, an adhesive, a dye, a retardant and an agent for odor characterization.

15. The lead-free and barium-free ignition composition of claim 14, wherein the inert substances are contained in a proportion from 0 to 20% by weight relative to the entire mixture.

16. The lead-free and barium-free ignition composition of claim 1, wherein the composition further contains vanilla as an agent for odor characterization.

17. A lead-free and barium-free ignition composition consisting of potassium dinitrobenzofuroxan, tetrazene, zinc peroxide, glass powder and an adhesive.

18. A lead-free and barium-free ignition composition that contains at least one initial explosive in a mixture with at least one oxygen-delivering substance, the composition consisting essentially of:

alkali metal and/or alkali earth metal salts of dinitrobenzofuroxan as the sole initial explosives, tetrazene as a sensitizer, and a mixture of multivalent metal oxides and metal peroxides as the oxygen-delivering substance, and further containing a reduction agent selected from the group consisting of carbon, metal powders of boron, cerium, titanium, zirconium and/or silicon, metal alloys, metal sulfides and metal hydrides.

19. The lead-free and barium-free ignition composition of claim 18, wherein the oxygen-delivering substance is a metal oxide selected from the group consisting of cerium dioxide, tungsten trioxide, tin dioxide and mixtures thereof.

20. The lead-free and barium-free ignition composition of claim 18 wherein the at least one initial explosive is contained in the composition in an amount of from 5 to 70% by weight, relative to the entire mixture.

21. The lead-free and barium-free ignition composition of claim 31 wherein the at least one initial explosive is contained in the composition in an amount of from 30 to 60% by weight, relative to the entire mixture.

22. The lead-free and barium-free ignition composition of claim 18 wherein the oxygen-delivering substance is contained in the composition in an amount of from 5 to 70% by weight, relative to the entire mixture.

23. The lead-free and barium-free ignition composition of claim 18 wherein the oxygen delivering substance is contained in the composition in an amount of from 8 to 60% by weight, relative to the entire mixture.

24. The lead-free and barium-free ignition composition of claim 18 wherein the reduction agent is selected from the group consisting of cerium-magnesium, cerium-silicon, titanium-aluminum, aluminum-magnesium, antimony sulfide molybdenum sulfide, titanium hydride and mixtures thereof.

25. The lead-free and barium-free ignition composition of claim 18 wherein the reduction agent is contained in an amount of from greater than 0 to 20% by weight, relative to the entire mixture.

26. The lead-free and barium-free ignition composition of claim 18, wherein the composition further contains at least one friction agent, at least one additional sensitizer, at least one additional secondary explosive and/or at least one inert substance.

27. The lead-free and barium-free ignition composition of claim 18, wherein the composition further contains at least one additional sensitizer and wherein the sensitizers are contained in an amount of from 0 to 30% by weight, relative to the entire mixture.

28. The lead-free and barium-free ignition composition of claim 18, wherein the composition further contains glass powder as a friction agent.

29. The lead-free and barium-free ignition composition of claim 18, wherein the composition further contains at least one friction agent in a amount of from more than 0 to 45% by weight, relative to the entire mixture.

30. The lead-free and barium-free ignition composition of claim 18 wherein the composition further contains at least one secondary explosive selected from the group consisting of hexogen and amino compounds of nitrated aromatics.

31. The lead-free and barium-free ignition composition of claim 18 wherein the composition further contains at least one secondary explosive in a amount of from more than 0 to 30% by weight, relative to the entire mixture.

32. The lead-free and barium-free ignition composition of claim 18, wherein the composition further contains at least one inert substance selected from the group consisting of a binder, an adhesive, a dye, a retardant and an agent for odor characterization.

33. The lead-free and barium-free ignition composition of claim 32, wherein the inert substances are contained in a proportion from 0 to 20% by weight relative to the entire mixture.

34. The lead-free and barium-free ignition composition of claim 18, wherein the composition further contains vanilla as an agent for odor characterization.

35. A lead-free and barium-free ignition composition consisting of potassium dinitrobenzofuroxan, tetrazene, zinc peroxide, tin dioxide, and titanium.

* * * * *